US006702197B2

(12) United States Patent
Hsueh et al.

(10) Patent No.: US 6,702,197 B2
(45) Date of Patent: Mar. 9, 2004

(54) ANTI-ELECTROSTATIC DISCHARGE SPRAY GUN APPARATUS AND METHOD

(75) Inventors: Rong Hau Hsueh, Jubei (TW); Simon King, Taipei (TW); Yung-Dar Chen, Hsin chu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 10/189,669

(22) Filed: Jul. 3, 2002

(65) Prior Publication Data

US 2004/0004140 A1 Jan. 8, 2004

(51) Int. Cl.[7] ..... B05B 15/02

(52) U.S. Cl. ..... 239/112; 239/690; 239/706; 239/707; 239/104; 239/106; 134/1.3; 134/902

(58) Field of Search ..... 239/690, 691, 239/704–707, 104, 105, 106, 112, 113; 222/318; 134/1.2, 1.3, 902

(56) References Cited

U.S. PATENT DOCUMENTS 3,740,612 A * 6/1973 Gauthier et al. ..... 361/227
3,844,477 A * 10/1974 Pollard et al. ..... 239/706
4,132,567 A * 1/1979 Blackwood ..... 134/1
4,713,257 A * 12/1987 Luttermoller ..... 427/483
4,752,034 A * 6/1988 Kuhn et al. ..... 239/690
5,119,991 A * 6/1992 Divers ..... 239/117
5,341,989 A * 8/1994 Fulkerson et al. ..... 239/3
5,351,903 A * 10/1994 Mazakas et al. ..... 239/705
5,409,162 A * 4/1995 Sickles ..... 239/3
5,837,064 A * 11/1998 Bowers ..... 134/6
5,885,351 A * 3/1999 Long et al. ..... 118/621
5,904,294 A * 5/1999 Knobbe et al. ..... 239/3
6,375,094 B1 * 4/2002 Schroeder et al. ..... 239/113
6,543,708 B1 * 4/2003 Stephenson, Jr. ..... 239/691

* cited by examiner

*Primary Examiner*—Henry Bennett
*Assistant Examiner*—Amanda Flynn
(74) *Attorney, Agent, or Firm*—Tung & Associates

(57) ABSTRACT

An anti-electrostatic discharge spray gun apparatus and method for preventing crystallization of particles formed as a result of electrostatic discharge from forming on a spray gun nozzle and an associated pair of oppositely charged electrodes disposed on the gun. The apparatus has a housing; a nozzle attached to the housing for dispensing gas; a device for dispensing a gas through the nozzle; a device for electrostatically discharging a gas dispensed through the nozzle; and a device for restricting the flow of a gas through the nozzle. The device for dispensing and restricting flow of a gas through the nozzle may be either a bypass piping having a flow control means or a stopper that operates to provide a constant but low volume flow of an inert gas such as nitrogen to the nozzle to prevent particle build up or crystallization from occurring.

20 Claims, 1 Drawing Sheet

ANTI-ELECTROSTATIC DISCHARGE SPRAY GUN APPARATUS AND METHOD

FIELD OF THE INVENTION

The present invention generally relates to an anti-electrostatic discharge spray gun apparatus and method for preventing crystallization of particles formed as a result of electrostatic discharge from forming on a spray gun nozzle and on a pair of oppositely charged electrodes disposed on the gun.

BACKGROUND OF THE INVENTION

An anti-electrostatic discharge or electrostatic discharge-dissipating spray air gun apparatus is well known in the art. Such an apparatus may be used in clean rooms for the manufacture of semiconductors. The apparatus normally includes a spray gun housing, a conduit for passing a fluid or gas therethrough, flow control means, a nozzle disposed between the electrodes, and a positively charged and a negatively charged electrode that cooperate to form an electric field and then discharge or deionize electrostatically charged particles that pass through the field. Typically, upon operation of the spray gun, a large volume of gas such as compressed air or an inert gas including but not limited to nitrogen and argon, flows through the conduit, and then through the nozzle disposed between the electrodes. Then the electrodes then discharge electrostatic ions present in the gas. However, over time, aerosol particles formed from the electrostatic discharge of the gas dispensed through the nozzle can cause a crystallized build-up of a material such as ammonium nitrate on the electrodes and the nozzle. This contamination of the electrodes and the nozzle can erode the electrodes and the nozzle, thus preventing the electrodes from performing their anti-electrostatic discharge function and preventing the nozzle from dispensing the gas.

The present invention provides a new deionizing or anti-electrostatic discharge air gun that avoids crystallization resulting from electrostatic discharge from forming on the electrodes and the nozzle.

It is therefore an object of the present invention to provide an apparatus for preventing particle build up on the electrodes in an anti-electrostatic discharge or electrostatic discharge-dissipating air gun that does not have the drawbacks or shortcomings of the conventional electrostatic air guns.

It is another object of the present invention to provide a method for preventing or reducing particle build up on the electrodes that utilizes a steady flow of compressed air or an inert gas such as nitrogen to prevent crystallization of the electrodes.

It is a further object of the present invention to provide an apparatus that will not erode electrodes or a nozzle of an anti-electrostatic spray gun.

SUMMARY OF THE INVENTION

In accordance with the present invention, an apparatus and method for preventing electrostatic discharge from contaminating a nozzle and an electrostatic discharge-dissipating device are provided.

In a preferred embodiment, an anti-electrostatic discharge spray gun apparatus for preventing electrostatic discharge from causing crystallization of the nozzle has:

(a) a housing;

(b) a nozzle attached to the housing having an orifice for dispensing gas;

(c) means for dispensing a gas through the nozzle;

(d) means for electrostatically discharging ions in a gas dispensed through the nozzle; and (e) means for restricting the flow of a gas through the nozzle.

The anti-electrostatic discharge spray gun is further directed to a hose in communication with a gas flow source and in further communication with the nozzle; a handle movably attached to the housing, wherein the handle is capable of moving between a first position and a second position wherein the handle is normally biased in the first position; and a trigger valve in communication with the hose wherein the hose, handle and trigger valve cooperate to define the means for dispensing a gas through the nozzle.

Additionally, the present invention is further directed to a bypass piping that operates to provide a constant but low volume flow of gas through the nozzle. The bypass piping further defines the means for restricting the flow of a gas through the nozzle.

In an alternative embodiment, the present invention is directed to a stopper that defines the means for dispensing gas through the nozzle and the means for restricting the flow of a gas through the nozzle. The stopper is disposed between the handle and the trigger valve that is in communication with the hose and cooperates with the handle and the trigger valve to provide a steady but low volume flow of gas through the nozzle.

Preferably, the means for electrostatically discharging ions in a gas dispensed through the nozzle is a pair of charged electrodes, each having an opposite polarity that cooperate to form an electric field for discharging ions present in the gas dispensed through the nozzle.

Additionally, a method of using the anti-electrostatic discharge apparatus is disclosed herein. The method provides for a steady flow of an inert gas to flow through the nozzle to prevent contamination, resulting from electrostatic discharge, of the electrodes and the nozzle.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

Figure 1:
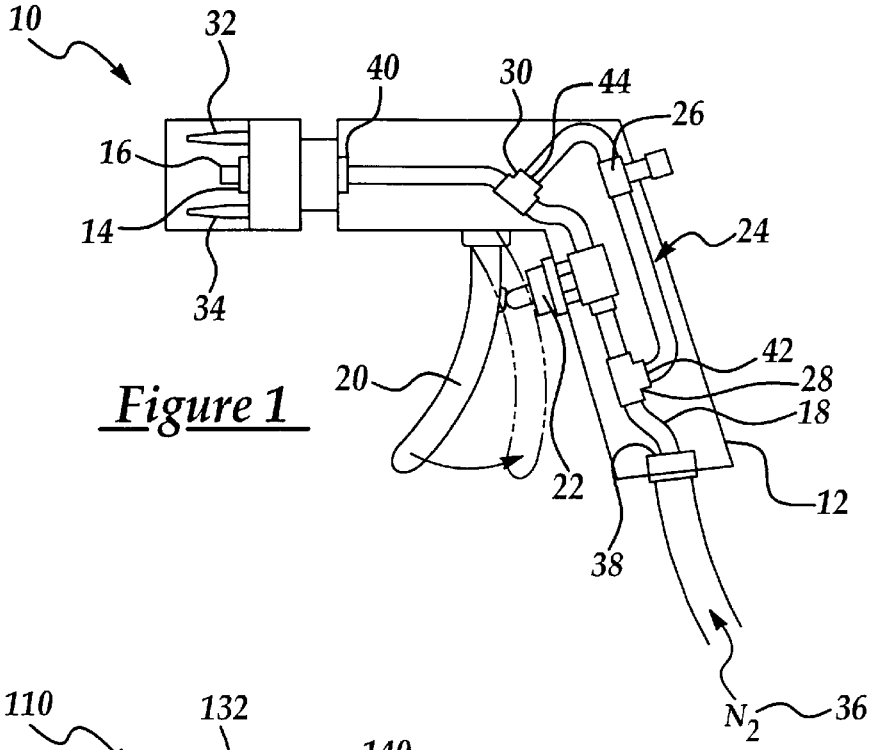
FIG. 1 is an elevational view of an anti-electrostatic discharge spray gun having a bypass piping in accordance with a preferred embodiment of the present invention.
Figure 2:
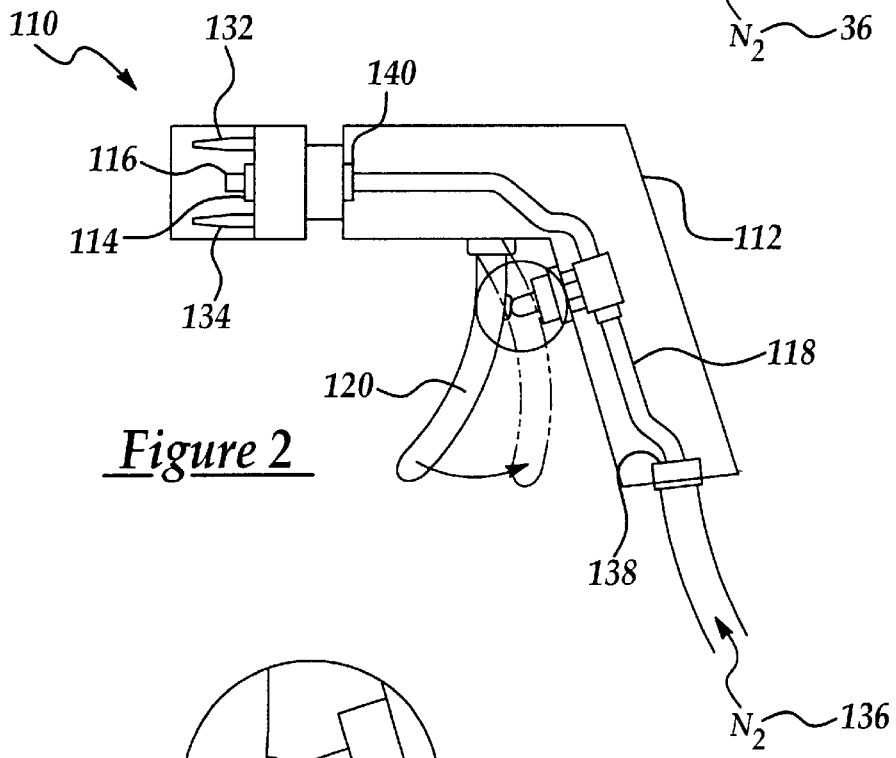
FIG. 2 is an elevational view of an anti-electrostatic discharge spray gun having a stopper in accordance with a preferred embodiment of the present invention.
Figure 3:
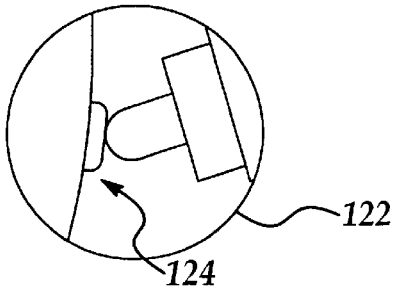
FIG. 3 is an enlarged view of a stopper and a portion of a trigger valve in accordance with a preferred embodiment of the present invention.

Referring now generally to the drawings, FIGS. 1–3, the present invention discloses an anti-electrostatic discharge spray gun apparatus having a nozzle; means for dispensing and means for restricting flow of a gas through a nozzle; and means for electrostatically discharging ions in a gas to prevent contamination of the nozzle caused by a crystallization buildup byproduct of an electrostatic discharge process.

As shown in a preferred embodiment in FIG. 1, the anti-electrostatic discharge spray gun is further directed to an anti-electrostatic discharge spray gun apparatus 10, 110 having a housing 12, 112; a nozzle 14, 114 attached to the housing; means for dispensing a gas through the nozzle; means for electrostatically discharging ions in a gas dispensed through the nozzle; and means for restricting the flow of a gas through the nozzle.

Preferably, a gas 36, 136 dispensed through the spray gun is dry compressed air or an inert gas such as nitrogen. The housing 12, 112 may be made from any durable material such as but not limited to metal or a high impact styrene material. The nozzle 14, 114 may be integrally formed with the housing or may be releasably and sealably attached to the housing 12, 112. The nozzle 14, 114 has an orifice 16, 116 disposed therethrough for dispensing the gas 36, 136 from the means for dispensing a gas through the nozzle to the atmosphere.

In a preferred embodiment as shown in FIG. 1, the means for dispensing gas through the nozzle 14 includes a hose 18, a handle 20, and a trigger valve 22. Preferably, the hose 18 has a uniform diameter D having a first end 38 in communication with a gas flow source (not shown) and a second end 40 in communication with the nozzle 14. The hose may be formed from any flexible material such as polyurethane or plastic.

Preferably, the handle 20 is disposed on the housing and is moved in a reciprocating manner between a first and a second position. The handle may be made from a durable material such as a high impact styrene material that is injection molded.

The handle 20 is movably attached to the housing 12 by a conventional fastening means well-known in the mechanical arts and moves between a first position and a second position. The handle 12 is normally biased by a biasing means in the first position, but in operation, is moved to the second position to dispense a large volume of gas through the hose 18.

The trigger valve 22 is disposed within the housing and is in communication with the hose 18. The trigger valve 22 is preferably a conventional valve well known in the pneumatic arts formed from a material such as nylon that is closed when the handle 20 is in the first position and is completely opened when the handle is in the second position. The handle 20 and the trigger valve 22 cooperate to dispense the gas 36 through the hose 18 by moving the handle 20 to the first position to close the trigger valve 22 and to the second position to open the trigger valve. Thus, when the trigger valve 22 is closed, the gas 36 is prevented from passing through the hose 18 and when the trigger valve 22 is open, a large volume of the gas 36 flows through the hose 18 from a gas source and then through the nozzle 14.

In a preferred embodiment as shown in FIG. 1, the means for dispensing a gas through the nozzle further has a bypass piping 24 in communication with the hose 18 and in further communication with the nozzle 14 for dispensing gas through the nozzle 14 when the trigger valve 22 is in a closed position. The bypass piping 24 has a uniform diameter less than the diameter D of the hose and allows a restricted flow of gas to flow through the bypass piping 24 and then through the nozzle 14. The bypass piping 24 further has means for restricting the flow of a gas through the nozzle. The means for restricting the flow of gas through the nozzle preferably has a flow control niddle valve 26 that is capable of being adjusted to allow either a maximum amount of restricted gas to flow through the bypass piping 24 or to prevent gas from flowing through the bypass piping 24. However, the flow control means is not limited to the niddle valve 26 but may be other conventional means for controlling flow of gas well known in the mechanical and pneumatic arts. The smaller diameter of the piping also cooperates to prevent a large volume of gas to flow through the bypass piping 24 when the niddle valve 26 is open.

Additionally, the bypass piping 24 further has a first end 42 disposed between the hose first end 38 and the trigger valve 22 in communication with the hose 18 and a second end 44 disposed between the trigger valve 22 and the hose second end 40 in further communication with the hose 18. The flow control niddle valve 26 is disposed between the first end 42 and the second end 44 of the bypass piping 24. The niddle valve 26 provides a restricted flow of gas through the bypass piping 24 when the niddle valve 26 is in an open position and stops a flow of gas through the bypass piping 24 when the niddle valve 26 is in a closed position. In operation, the niddle valve 26 is biased in an open position to allow a steady flow of gas 36 to flow through the bypass piping 24 and then through the nozzle 14.

The first end 42 of the bypass piping 24 is preferably, connected to the hose 18 by a first tee-shaped connector 28, and the second end 44 of the bypass piping 24 is preferably, connected to the hose 18 by a second tee-shaped connector 30. However, in an alternative embodiment, the first end 42 of the bypass piping 24 may be connected directly to the nozzle 14 and the second end 44 may be connected directly to a gas source (not shown).

The anti-electrostatic discharge spray gun 10 further has a positively charged electrode 32 preferably having a first pointed tip; and a negatively charged electrode 34 preferably having a pointed tip. Each electrode 32, 34, respectively, is connected to a charging source (not shown). The charged electrodes 32, 34 define the means for electrostatically discharging ions in a gas dispensed through the nozzle 14. The electrodes 32, 34 preferably surround the nozzle 14, thus the nozzle 14 is disposed between the two electrodes 32, 34. In operation, an electric field is formed between the charged electrodes that operate to deionize ions dispensed through the orifice 16 in the nozzle 14 and then through the electric field.

According to the preferred embodiment shown in FIG. 1, in operation, the handle 20 is biased normally in the first position and accordingly, the trigger valve 22 is biased in a closed position to prevent gas from flowing through the hose 18 when the handle 20 is in the first position. As the handle 20 moves from the first position to the second position, the gas 36 flows from the fluid source through the hose 18. When the handle 20 is moved to the second position, the handle 20 completely engages and opens the trigger valve 22, thus, allowing an unrestricted flow of high volume of gas to flow through the hose 18. After the gas 36 is dispensed through the hose 18, the handle 20 returns to the first position and thus, causes the trigger valve 22 to close.

The gas 36 dispensed through the hose 18 may become ionized while passing through the hose 18 but before being dispensed through the orifice 16 in the nozzle 14. The gas 36 is deionized after being dispensed through the nozzle 14 and passed through the electric field.

The bypass piping 24 flow control niddle valve 26 is normally biased in an open position to allow a restricted flow of low volume of gas to flow through the bypass piping 24 at a constant rate. The operation of the flow control niddle valve 26 is preferably, independent of the trigger valve 22 such that gas flows through the bypass piping 24 when the flow control niddle valve 26 is open regardless of whether the trigger valve 22 is opened or closed. The constant flow of inert gas 36 flowing through the bypass valve 24 prevents crystallization build-up resulting from electrostatic discharge on the electrodes 32, 34.

In a preferred embodiment as shown in FIGS. 2–3, the means for dispensing gas through a nozzle includes a hose 118, a handle 120, and a trigger valve 122.

Preferably, the hose 118 has a uniform diameter D having a first end 138 in communication with a gas flow source (not shown) and a second end 140 in communication with the nozzle 114. Preferably, the handle 120 is moved in a reciprocating manner between a first and a second position.

The handle 120 is movably attached to the housing 112 by conventional fastening means well-known in the mechanical arts and moves between a first position and a second position. The handle 120 is normally biased by a biasing means in the first position, but in operation, is moved to the second position to dispense a large volume of gas through the hose 118.

The trigger valve 122 is disposed within the housing and is in communication with the hose 118. The trigger valve 122 is preferably a conventional valve well known in the pneumatic arts that is closed when the handle 120 is in the first position and is completely opened when the handle 120 is in the second position. The handle 120 and the trigger valve 122 cooperate to dispense a gas 136 through the hose 120 by moving the handle 120 to the first position to close the trigger valve 122 and to the second position to open the trigger valve 122. Thus, when the trigger valve 122 is closed, the gas 136 is prevented from passing through the hose 118 and when the trigger valve 122 is open, a large volume of gas flows through the hose 118 from a gas source and then through the nozzle 114.

The means for dispensing a gas through the nozzle further has a stopper 124 disposed between the handle 120 and the trigger valve 122. The stopper 124 is preferably a resilient member made from a material such as rubber. The stopper 124 further defines the means for dispensing a gas through the nozzle and defines the means for restricting the flow of gas through the nozzle. The stopper 124 cooperates with the handle 120 and the trigger valve 122 to provide a restricted flow of gas through the hose 118 by engaging and thus, partially opening the trigger valve 122 when the handle 120 is in the first position, and to provide an unrestricted flow of gas through the hose 118 by engaging and completely opening the trigger valve 122 when the handle 118 is in the second position. The trigger valve 122 is normally biased in a partially open position when the handle 120 is in the first position to allow a restricted flow of gas to flow through the hose 118 and then through the nozzle 114.

The anti-electrostatic discharge spray gun 110 further has a positively charged electrode 132 preferably having a first pointed tip; and a negatively charged electrode 134 preferably having a second pointed tip. Each electrode 132, 134, respectively, is connected to a charging source (not shown). The charged electrodes 132, 134 define the means for electrostatically discharging ions in a gas dispensed through the nozzle 114. The electrodes 132, 134 preferably surround the nozzle 114, thus, the nozzle 114 is disposed between the two electrodes 132, 134. In operation, an electric field is formed between the charged electrodes 132, 134, that operates to deionize ions dispensed through the orifice 116 in the nozzle 114 and then through the electric field.

In operation, the handle 120 is biased normally in the first position and accordingly, the trigger valve 122 is biased in a partially open position to allow a low volume and constant but restricted flow of gas 126 to flow through the hose 118 when the handle 120 is in the first position. As the handle 120 moves from the first position to the second position, gas flows from the fluid source through the hose 118. When the handle 120 is moved to the second position, the handle 120 completely engages and opens the trigger valve 122, thus, allowing an unrestricted flow of high volume of gas to flow through the hose 118. After gas is dispensed through the hose 118, the handle 120 returns to the first position and thus, causes the trigger valve 122 to be partially open.

Inert gas 136 dispensed through the hose 118 may become ionized while passing through the hose 118 but before being dispensed through the orifice 116 in the nozzle 114. The gas 136 is deionized after being dispensed through the nozzle 114 and passed through the electric field.

The constant flow of inert gas flowing through the hose prevents an electrostatic discharge crystallization build-up on the tips of the electrodes and on the nozzle.

What is claimed is:

1. An anti-electrostatic discharge spray gun apparatus comprising:

a housing;

a nozzle attached to the housing having an orifice for dispensing gas;

means for dispensing a gas through the nozzle;

means for electrostatically deionizing ions in a gas dispensed through the nozzle, wherein the means for electrostatically deionizing ions in a gas dispensed through the nozzle has a positively charged electrode; and a negatively charged electrode, wherein the nozzle is disposed between the positively and the negatively charged electrodes; and means for restricting the flow of a gas through the nozzle.

2. The apparatus of claim 1 wherein the means for dispensing gas through the nozzle comprises:

a hose with a uniform diameter having first end in communication with a gas flow source and a second end in communication with the nozzle;

a handle movably attached to the housing, wherein the handle is capable of moving between a first position and a second position wherein the handle is normally biased in the first position; and a trigger valve in communication with the hose disposed within the housing, wherein the handle and the trigger valve cooperate to dispense gas through the hose by positioning the handle in the first position to close the trigger valve and in the second position to open the trigger valve.

3. The apparatus of claim 2 wherein the means for dispensing a gas through the nozzle comprises:

a bypass piping in communication with the hose and in further communication with the nozzle for dispensing gas through the nozzle when the trigger valve is in a closed position, the bypass piping having a uniform diameter less than the diameter of the hose.

4. The apparatus of claim 3 wherein the bypass piping further defines the means for restricting the flow of a gas through the nozzle.

5. The apparatus of claim 4 comprising a flow control niddle valve defining the means for restricting the flow of gas through the nozzle.

6. The apparatus of claim 5 wherein the bypass piping further comprises:

a first end in communication with the hose; and a second end in further communication with the hose, wherein the flow control niddle valve is disposed between the first end and the second end of the bypass piping, and wherein the niddle valve provides a restricted flow of gas through the bypass piping when the niddle valve is in an open position and stops a flow of gas through the bypass piping when the niddle valve is in a closed position.

7. The apparatus of claim 5 wherein the first end of the bypass piping is connected to the hose by a first tee-shaped connector, and wherein the second end of the bypass piping is connected to the hose by a second tee-shaped connector.

8. The apparatus of claim 1 wherein the means for providing a restricted flow of gas through the nozzle comprises:

a handle movably attached to the housing, wherein the handle is capable of moving between a first position and a second position wherein the handle is normally biased in the first position;

a trigger valve in communication with a hose disposed within the housing, the hose having a uniform diameter having first end in communication with a gas flow source and a second end in communication with the nozzle; and a stopper disposed between the handle and the trigger valve, wherein the stopper cooperates with the handle, and with the trigger valve to provide a restricted flow of gas through the hose by engaging and partially opening the trigger valve when the handle is in the first position, and wherein the stopper cooperates with the handle, and with the trigger valve to provide an unrestricted flow of gas through the hose by engaging and completely opening the trigger valve when the handle is in the second position.

9. The apparatus of claim 1 wherein the gas is an inert gas.

10. The apparatus of claim 9 wherein the inert gas comprises nitrogen.

11. An anti-electrostatic discharge spray gun apparatus comprising:

a housing;

a nozzle attached to the housing having an orifice for dispensing gas;

a hose having a uniform diameter having first end in communication with a gas flow source and a second end in communication with the nozzle;

a handle movably attached to the housing, wherein the handle moves between a first and a second position, and wherein the handle is normally biased in the first position;

a trigger valve disposed within the housing in communication with the hose, wherein the handle and the trigger valve cooperate to dispense gas through the hose when the handle moves from the first position to the second position;

means for providing a restricted flow of gas through the nozzle; and means for electrostatically deionizing ions in a gas dispensed through the nozzle, wherein the means for electrostatically deionizing ions in a gas dispensed through the nozzle has a positively charged electrode; and a negatively charged electrode, wherein the nozzle is disposed between the positively and the negatively charged electrodes.

12. The apparatus of claim 11, further comprising:

a bypass piping for dispensing gas through the nozzle when the trigger valve is in a closed position, the bypass piping in communication with the hose and in further communication with the nozzle having a uniform diameter less than the diameter of the hose, the bypass piping further having means for restricting flow of gas through the nozzle and wherein the bypass piping is disposed between the hose first end and the hose second end.

13. The apparatus of claim 12 further comprises a flow control niddle valve, the flow control niddle valve defining the means for providing a restricted flow of gas through the nozzle.

14. The apparatus of claim 13 wherein the bypass piping further comprises:

a first end in communication with the hose; and a second end in further communication with the hose, wherein the flow control niddle valve is disposed between the first end and the second end of the bypass piping, and wherein the niddle valve provides a restricted flow of gas through the bypass piping when the niddle valve is in an open position and stops a flow of gas through the bypass piping when the niddle valve is in a closed position.

15. The apparatus of claim 14 wherein the first end of the bypass piping is connected to the hose by a first tee-shaped connector disposed between the hose first end and the trigger valve, and wherein the second end of the bypass piping is connected to the hose by a second tee-shaped connector disposed between the hose second end and the niddle valve.

16. The apparatus of claim 11, wherein the means for providing a restricted flow of gas through the nozzle comprises:

a stopper disposed between the handle and the trigger valve, the stopper cooperating with the handle and the trigger valve to provide a restricted flow of gas through the hose by engaging and partially opening the trigger valve when the handle is in the first position, and wherein the stopper cooperates with the handle, and with the trigger valve to provide an unrestricted flow of gas through the hose by engaging and completely opening the trigger valve when the handle is in the second position.

17. The apparatus of claim 16 wherein the stopper is a resilient member.

18. A method of preventing crystallization due to electrostatic discharge on an anti-electrostatic spray gun nozzle and associated pair of electrodes of claim 1 comprising the steps of:

using the means for restricting the flow of a gas through the nozzle to dispense a constant but low volume of gas through the nozzle; and electrostatically deionizing ions in a gas dispensed through the nozzle.

19. An anti-electrostatic discharge spray gun apparatus comprising:

a housing having a hose disposed therewithin;

a nozzle attached to the housing having an orifice for dispensing gas;

means for dispensing a gas through the nozzle;

means for means for electrostatically deionizing ions in a gas dispensed through the nozzle; and means for restricting the flow of a gas through the nozzle wherein the means for restricting a gas through the nozzle comprises a bypass piping in communication with the hose and in further communication with the nozzle for dispensing gas through the nozzle when the trigger valve is in a closed position, the bypass piping having a uniform diameter less than the diameter of the hose.

20. An anti-electrostatic discharge spray gun apparatus comprising:

a housing;

a nozzle attached to the housing having an orifice for dispensing gas;

a hose with a uniform diameter having first end in communication with a gas flow source and a second end in communication with the nozzle;

means for dispensing a gas through the nozzle;

means for means for electrostatically deionizing ions in a gas dispensed through the nozzle; and means for restricting the flow of a gas through the nozzle wherein the means for restricting a gas through the nozzle has a handle movably attached to the housing, wherein the handle is capable of moving between a first position and a second position wherein the handle is normally biased in the first position, a trigger valve in communication with the hose disposed within the housing, and a stopper disposed between the handle and the trigger valve, wherein the stopper cooperates with the handle, and with the trigger valve to provide a restricted flow of gas through the hose by engaging and partially opening the trigger valve when the handle is in the first position, and wherein the stopper cooperates with the handle, and with the trigger valve to provide an unrestricted flow of gas through the hose by engaging and completely opening the trigger valve when the handle is in the second position.

* * * * *